United States Patent [19]

Williams

[11] 4,192,548

[45] Mar. 11, 1980

[54] APPARATUS AND METHOD FOR RECONSTITUTING SEAT BACKS

[76] Inventor: Amos Williams, 70 S. 29th St., Wyandanch, N.Y. 11798

[21] Appl. No.: 857,393

[22] Filed: Dec. 5, 1977

[51] Int. Cl.[2] ..... A47C 7/02

[52] U.S. Cl. ..... 297/452; 297/218

[58] Field of Search ..... 297/218, 283, 452, 454, 297/455, 219, 229

[56] References Cited

U.S. PATENT DOCUMENTS

| | | | |
|---|---|---|---|
| 1,885,109 | 11/1932 | Burkart | 297/454 |
| 2,251,318 | 8/1941 | Blair et al. | 297/455 X |
| 2,619,156 | 11/1952 | Seaman | 297/229 |
| 2,865,436 | 12/1958 | Thorne | 297/218 X |
| 3,073,649 | 1/1963 | Montforte | 297/396 |
| 3,515,430 | 6/1970 | Nelson | 297/218 |
| 3,827,752 | 8/1974 | Bissinger | 297/452 |

FOREIGN PATENT DOCUMENTS

| | | | |
|---|---|---|---|
| 929026 | 6/1963 | United Kingdom | 297/229 |
| 929027 | 6/1963 | United Kingdom | 297/229 |

*Primary Examiner*—James C. Mitchell

*Attorney, Agent, or Firm*—Posnack, Roberts, Cohen & Spiecens

[57] ABSTRACT

For reconstituting a seat back formed of a metal frame and a back member, there is provided a cover which includes inner and outer cover members laminated together. The inner member is formed of foam or sponge and is one-sided with pockets in the upper corners thereof to be draped over the frame. The inner member is covered by a vinyl outer cover member which has recesses cut therein to faciliate closing the same around the frame.

5 Claims, 8 Drawing Figures

APPARATUS AND METHOD FOR RECONSTITUTING SEAT BACKS

FIELD OF INVENTION

This invention relates to upholstery and more particularly to the reclaiming of seats particularly with reference to mass transportation vehicles.

BACKGROUND

With respect to mass transportation vehicles such as school busses, there is a substantial need for the reconstitution of seat backs and the like so that equipment can be modernized and restored as to appearance.

There is also a need for safety improvement inasmuch as old bus designs have employed exposed metal frames which, experience has shown, can result in injury when there are accidents or when there are short stops and even when the passengers are involved in frivolous conduct or the like.

Heretofore, the reconstitution of seat backs and such has involved the individual treatment of each seat and the custom reupholstering of the same. This generally involves much time and cost without providing any particular benefits.

SUMMARY OF INVENTION

It is an object of the invention to provide improved methods for upholstering seat backs and the like for reconstituting the same in mass transportation vehicles and in like applications.

It is another object of the invention to provide for improving safety conditions relative to seating arrangements in busses or the like.

Still another object of the invention is to reduce the time and costs involved in reupholstering bus seats and the like.

Yet another object is to provide the above objects while further providing for converting old bus seats to modern, strong, heavily padded equipment adapted to resist laceration, wear, abrasion and other such abuse.

In achieving the above and other objects of the invention there is provided a method of reconstituting a seat back or the like, said seat back having a vertical frame of generally rectangular form with two upper corners and a back member covering said frame, said method comprising forming an inner sponge-like cover and mounting the same on said seat back to cover said corners and at least one side of said frame, and covering the inner cover and frame with a plastic pocket-like cover to resist laceration, wear and abrasion.

According to a feature of the invention, said inner cover is formed with a shape corresponding generally to that of said seat back but with two pockets corresponding in position to the upper corners of said frame, said pockets being engaged with said corners to conceal the same and to support the inner cover on said frame.

According to a further feature of the invention, said back member may be mounted on one side of said frame and may define a depression therewith, said method comprising forming the inner cover with at least one generally complete side which is arranged at least substantially in said depression to fill said frame.

According to yet another feature of the invention, the inner cover is formed to be substantially open, with the exception of said pocket, on the side opposite said complete side.

According to still another feature of the invention, said pockets may be formed of a material approximately twice as thick as the material of said complete side.

According to another aspect of the invention, the outer cover may be formed with two faces and a connecting edge therebetween and with a downwardly opening mouth so that the outer cover can be placed over said frame, said method further comprising forming recesses in said edge adjacent said mouth to facilitate closing said mouth around said frame and inner cover.

According to another feature of the invention, the outer cover may be laminated to the inner cover prior to installation and particularly at the time of manufacture.

According to yet another aspect of the invention, the outer cover may be made of vinyl and the inner cover of, for example, a class 4 urethane foam.

According to still another aspect of the invention, there is provided a cover for a seat back having a generally vertical frame with two upper corners and a back member on said frame and defining a depression therewith, said cover comprising inner and outer cover members, said inner member being of a sponge-like material, said inner member having at least one side adapted for fitting at least substantially into said depression and two corner pockets on said side adapted for being draped over the upper corners of said frame, the other side of said inner cover member being substantially open, said outer cover member being of a plastic material and covering said inner member and forming therewith a downwardly opening mouth to facilitate mounting the cover over said frame and back member.

A further aspect of the invention involves that the outer cover member and inner cover member are laminated together as mentioned hereinabove with respect to the method.

The invention moreover involves that the outer cover member be formed of two sides and an interconnecting edge, said edge being provided with recesses adjacent said mouth to facilitate closing the outer cover member around the frame.

Still another advantageous aspect of the invention involves that the inner cover member inclusive of the aforesaid pockets be of a one piece monolithic structure.

The above and further objects, features and advantages of the invention will be found in greater detail in the following description of a preferred embodiment of the invention as illustrated in the accompanying drawing.

BRIEF DESCRIPTION OF DRAWING

FIG. 6 (*b*) is a view corresponding to the bottom portion of FIG. 6(*a*) to form therewith a broken-away composite of the seat back of the invention.

DETAILED DESCRIPTION

In accordance with the invention, metal rimmed seats in old busses or other like mass transportation vehicles can be converted to modernized strong heavily padded childproof seats. All exposed metal edges may be covered with a thick safety padding for protection. Bus seats and the like can be completely reupholstered to comply with the latest safety standards and in some instances this will avoid having to buy new vehicles at the cost of many thousands of dollars.

Older vehicles now being used as backup equipment because they do not meet safety standards can be modernized and used as first line equipment for a relatively small investment.

Figure 1:
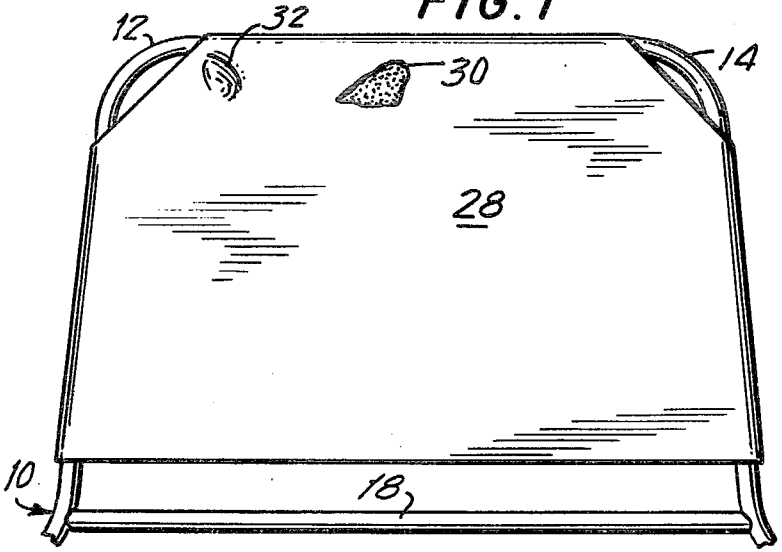
FIG. 1 is a front view of a seat back requiring reupholstering.
Figure 3:
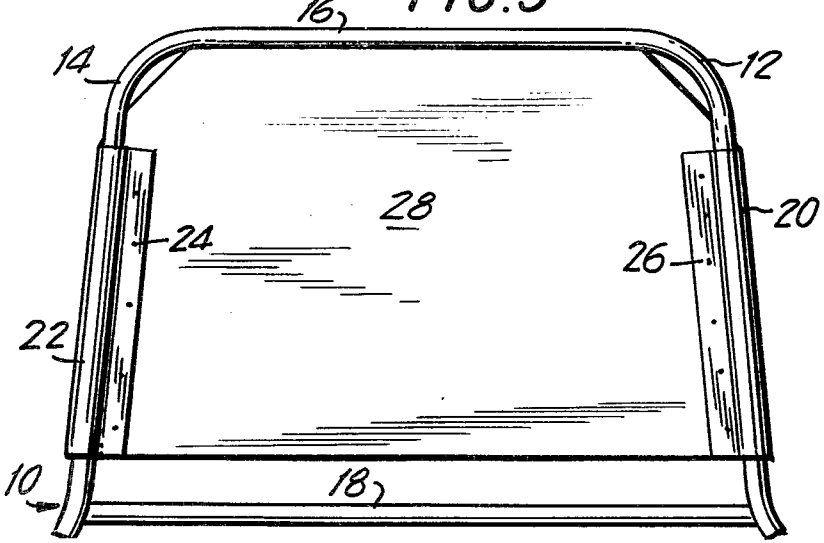
FIG. 3 is a back view of the seat back of FIG. 1.

FIGS. 1 and 3 illustrate respectively the front and back of a metal rimmed seat requiring conversion or reupholstering in accordance with the provisions of the invention. More particularly, there is illustrated in these figures a metal frame 10 of generally rectangular shape having exposed upper corners 12 and 14. The frame consists of an upper horizontal member 16, a lower horizontal member 18 and sides or edges 20 and 22. Metal strips 24 and 26 provide for mounting on one side of the frame a back member 28. This back member may have been subject to wear, abrasion, laceration and other types of abuse such as indicated at 30 and 32 in FIG. 1. It is an object of the invention to restore such a seat back and conceal the wear and tear thereof while at the same time providing improved safety factors with respect to the metal frame and other constructional aspects of the original seat.

Figure 2:
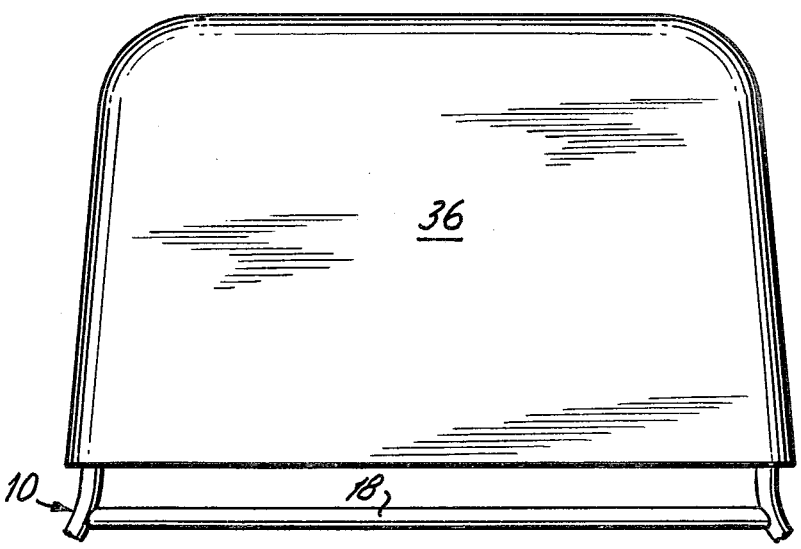
FIG. 2 is a view of the seat back of FIG. 1 after it has been reupholstered in accordance with the invention.
Figure 4:
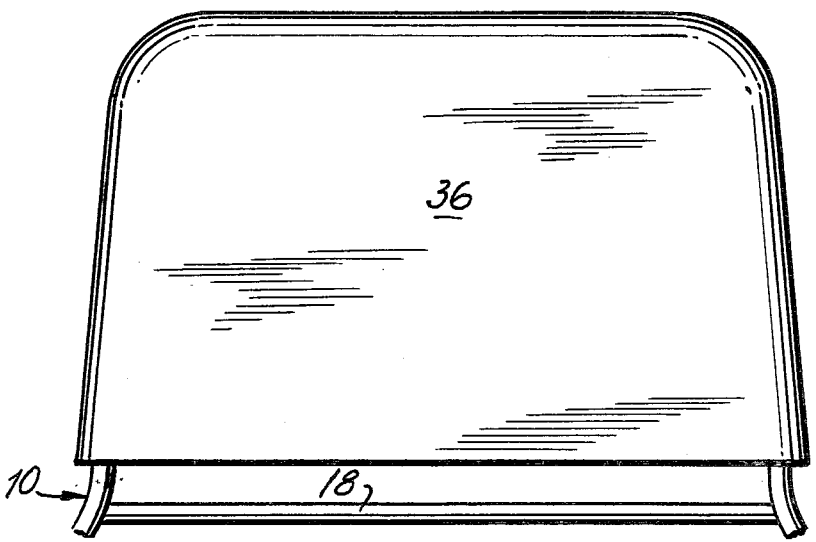
FIG. 4 is a rear view of the seat back as reupholstered in FIG. 2.

As is seen in FIGS. 2 and 4 the frame 10 is substantially concealed and an outer covering 36 is all that is visible, the seat having been reconstituted and modernized as well as provided with an additional safety factor in accordance with the invention.

As will be discussed in greater detail hereinbelow, the cover of the invention consists of two parts which are laminated together to form a one-piece unit. The cover includes inner and outer cover members, both of which are one-piece monolithic structures.

Figure 5:
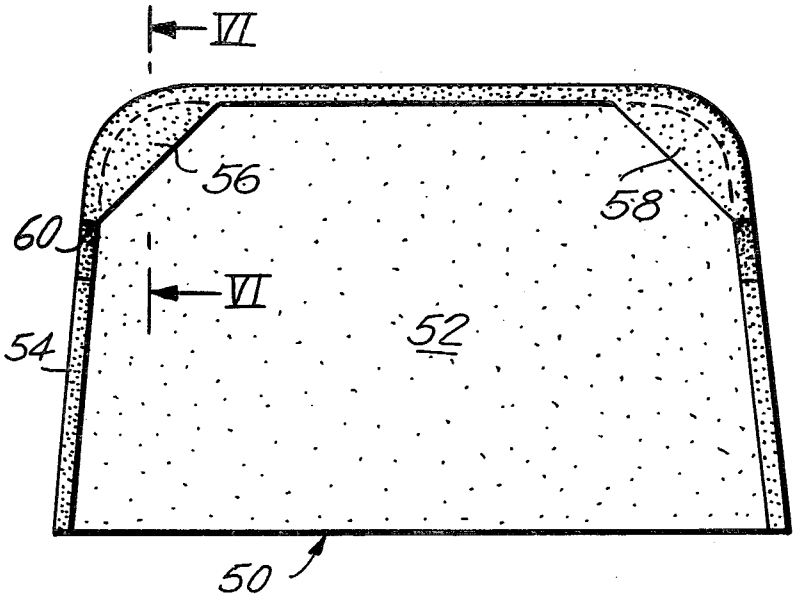
FIG. 5 is a front view of the inner cover member provided in the cover of the invention.

The inner cover member of the invention is seen in front view in FIG. 5. Therein will be seen the inner cover member 50 consisting of a complete imperforate side 52 bounded by an edge 54 and having a generally rectangular form to correspond with the form of the frame of the seat to be reupholstered as has been indicated hereinabove.

At the upper corners of the cover member 50 are provided two pockets 56 and 58. These pockets are formed in monolithic relationship with the rest of the structure which is as a whole molded of a plastic material such as a foamed plastic and more specifically preferably a foamed urethane plastic of class 4 (firm). As will be seen in FIG. 6(*a*) the pocket 56 for example has a thickness T1 which is approximately twice the thickness T2 of the side 52 of the inner cover member 50. This enables the pocket to conceal the associated exposed corner of the metal frame and to prevent injury from unexpected contact with the metal frame by passengers in the bus. It will also be seen that the pocket 56 terminates at periphery 60 the other side of the inner cover member 50 thus being substantially and generally open.

Figure 6A:
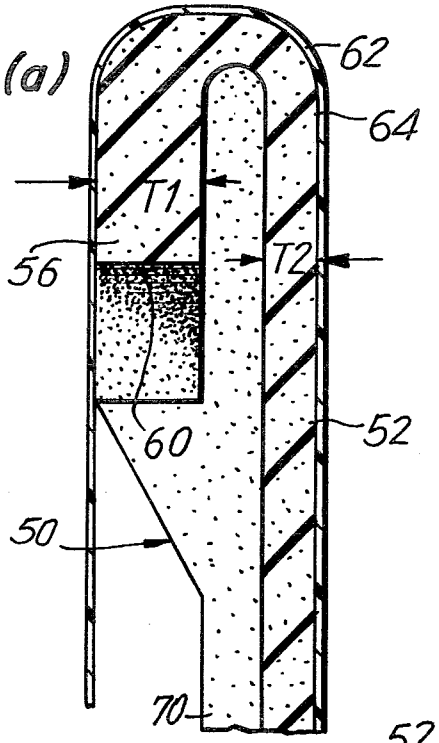
FIG. 6 (*a*) is a cross-sectional view taken along line VI—VI in FIG. 5.
Figure 6B:
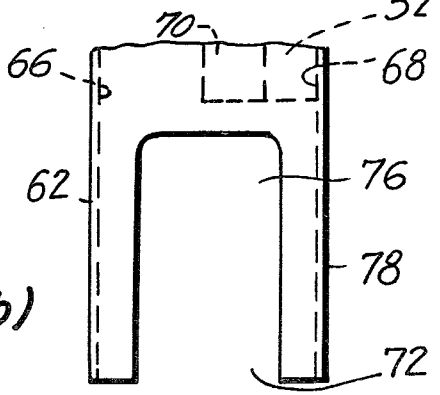

FIG. 6(*a*) furthermore illustrates the outer cover member 62 forming a part of the cover of the invention. Preferably, the outer cover member 62 is fabricated of a plastic or the like and this plastic is laminated to the sponge-like inner cover member 50 as indicated at the surface 64.

The bottom of the structure illustrated in FIG. 6(*a*) is shown in FIG. 6(*b*), wherein is seen the lower extremity of the outer cover member 62. The inner surface of the outer cover member is indicated by the use of dash lines at 66 and 68. The edge of the inner cover member 50 is indicated at 70 and the cross-section of the side 52 of the inner cover member is also visible.

The outer cover member defines with the inner cover member a downwardly opening mouth 72 by means of which the cover is placed over the seat to be reupholstered. Adjacent this mouth the outer cover member is provided in each of its edges with a recess or slot 76. This recess or slot is intended to permit the lower peripheral portion 78 and 80 of the outer cover member to be constituted as facing flaps which are adapted to be folded over one another and to be bonded to each other by a cement, stitching, stapling or the like whereby the cover member is held on the frame of the seat being reupholstered.

Figure 7:
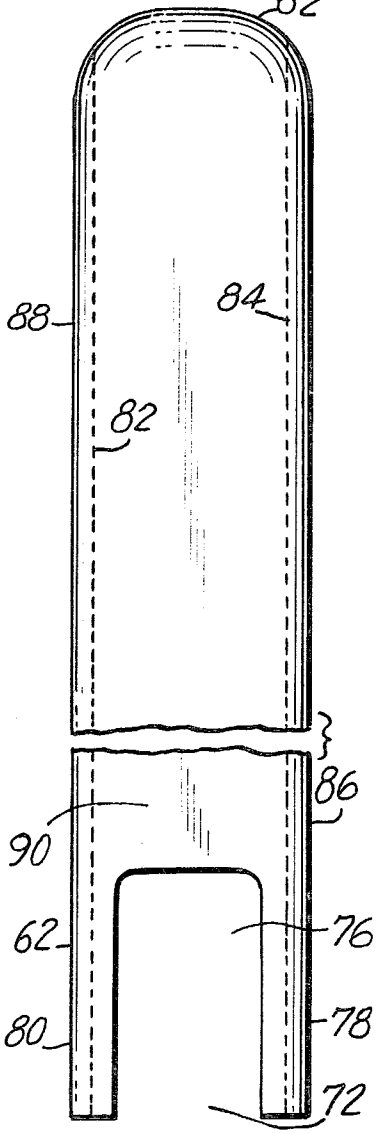
FIG. 7 is an end or edge view of the outer cover member of the cover of the invention.

The outer cover member is shown in broken-away view in FIG. 7 whereat appears the stitching or piping 82 and 84. In fact it will be noted that the outer cover member is provided with a complete side 86 and a complete side 88 in turn connected by edge portions 90 interconnecting the same. Also visible in FIG. 7 is the mouth 72 and the recess or slot 76 along with peripheral portions 78 and 80 as have been mentioned hereinabove.

From the above it will be seen that there is provided in accordance with the invention a cover for a seat back having a generally vertical frame with two exposed upper corners and a back member mounted on the frame. The back member being on one side of the frame forms a hollow or a depression therewith. This depression is the depression which accommodates the complete side 52 of the inner cover member with the inner cover member being confined to the depression by the action of the outer cover member constituting the strength giving structural member of the cover of the invention.

As has been noted hereinabove the cover comprises inner and outer cover members the inner member being of a sponge-like material and having at least one side adapted for fitting at least substantially into the above-mentioned depression and two corner pockets on this side adapted for being draped over the upper corners of the frame. The other side of the inner cover member as noted above is substantially open. The outer member is of a plastic material and covers the inner member and forms therewith a downwardly opening mouth to facilitate mounting the cover over the frame and back member. As has also been noted above, the inner and outer cover members are preferably laminated to form a one-piece structure.

According to the method of the invention this method applies to reconstituting a seat back in a situation wherein the seat back has a vertical frame of generally rectangular form with two upper corners and a back member covering this frame, said method comprising a inner sponge-like cover and mounting the same on said seat back to cover said corners and having at least one side of the frame and covering the inner cover and frame with a plastic pocket-like cover to resist laceration, wear and abrasion.

There will now be obvious to those skilled in the art many modifications of the method and apparatus set forth hereinabove. These variations and modifications will not depart from the scope of the invention if defined by the following claims.

What is claimed is:

1. A cover for a seat back having a generally vertical frame with two upper corners and a back member on said frame and defining a depression therewith, said cover comprising inner and outer cover members, said inner member being of a sponge-like material, said inner member having at least one side adapted for fitting at least substantially into said depression and two corner pockets on said side adopted for being draped over the upper corners of said frame, the other side of said inner cover member being substantially open, said outer cover member being of a plastic material and covering said inner member and forming therewith a downwardly opening mouth to facilitate mounting the cover over said frame and back member, said outer cover member and said inner cover member being laminated together, said cover member being formed of two sides and an interconnecting edge, said edge being provided with recesses extending into said sides adjacent said mouth to form facing flaps which are adapted for interconnection thereby to facilitate closing the outer cover member around said frame.

2. A cover as claimed in claim 1 wherein the outer cover member is vinyl and the inner cover member including said pockets is of plastic foam.

3. A cover as claimed in claim 1 wherein the material of said pockets is about twice the thickness of the material of said one side of said inner member.

4. A cover as claimed in claim 1 wherein said outer member extends beyond said inner member substantially to the depth of said recesses.

5. A cover as claimed in claim 1 wherein the inner cover member inclusive of said pockets is of a one-piece monolithic structure.

* * * * *